US006639601B1

(12) United States Patent
Asai et al.

(10) Patent No.: US 6,639,601 B1
(45) Date of Patent: Oct. 28, 2003

(54) IMAGE DISPLAY APPARATUS AND IMAGE DISPLAY METHOD

(75) Inventors: Yosuke Asai, Tokyo (JP); Akio Uekawa, Tokyo (JP); Shinichiro Araki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 400 days.

(21) Appl. No.: 09/606,073

(22) Filed: Jun. 29, 2000

(30) Foreign Application Priority Data

Jun. 29, 1999 (JP) ..... 11-184297
Nov. 18, 1999 (JP) ..... 11-328670

(51) Int. Cl.[7] ..... G09G 15/00
(52) U.S. Cl. ..... 345/474; 345/781; 345/788
(58) Field of Search ..... 345/781–789, 345/474

(56) References Cited

FOREIGN PATENT DOCUMENTS

JP 7-200856 8/1988

OTHER PUBLICATIONS

Foley et al. "Computer Graphics Principles and Practice" second edition in C, pp 364–366, 1996.*

Tanikoshi et al.; "Design concept of a system for developing application–dependent user interface", *IEEE*, pp. 776–782, 1991.

* cited by examiner

*Primary Examiner*—Almis R. Jankus
(74) *Attorney, Agent, or Firm*—Leydig, Voit & Mayer, LTD

(57) ABSTRACT

At least one graphic element includes basic element data of an image, such as a menu, and attributes of the basic element. At least one animation element associated with the graphic element describes a condition and a procedure for dynamically changing an attribute of the graphic element when the condition is fulfilled. The graphic element and the animation element are stored as drawing data. When the condition is fulfilled, the procedure described in the animation element is executed so that an attribute of the graphic element is changed.

16 Claims, 12 Drawing Sheets

IMAGE DISPLAY APPARATUS AND IMAGE DISPLAY METHOD

BACKGROUND OF THE INVENTION

1. Field of the Invention

The present invention generally relates to image display apparatus, and image display methods and, more particularly, to an image display apparatus and image display method in which the status of display is caused to transit in accordance with status transition data corresponding to a predetermined instruction, post-transition display data is created from drawing data, and an image is displayed based on the display data.

2. Description of the Related Art

On-vehicle Navigation apparatus which are used recently have been usually provided with extra functions in addition to an ordinary function for displaying maps. These extra functions include displaying of a current location, setting of a destination, searching for a route from the current location to the destination, outputting of visual and/or voiced guidance corresponding to the route, and searching for related information in a built-in database. In order to facilitate use of these functions, an on-vehicle navigation apparatus is provided with menu displaying function that allows selection of a desired one of these functions. Usually, a menu listing various functions is displayed along with a map on a display unit. The function corresponding to a selection by a user at the apparatus or a selection by a remote controller is executed. For example, the apparatus itself or the remote controller is provided with scroll buttons or selection buttons that accept the user operation. Alternatively, a transparent touch panel is provided on a screen of the display unit.

Drawing data for shapes, colors and displayed position of a design created by a graphical editor or the like is built in the apparatus in order to display an image of the menu. Procedures for transition between different statuses of display based on the drawing data, i.e. procedures for switching between a displayed state and a non-display state of the image, change in color, change in shape, change in size, are stored in the apparatus in the form of state transition data which complies with the specification of the apparatus.

FIG. 12 is a block diagram of a related art image display apparatus built in an on-vehicle navigation apparatus to display the menu. Referring to FIG. 12, numeral 201 indicates a state transition controller receiving a instruction from another apparatus built in the on-vehicle navigation apparatus, searching for state transition data 211 based on the instruction and supplying an instruction for modification of display based on the state transition data to a drawing controller 204. Numeral 202 indicates a state transition data storage unit for storing the state transition data 211 corresponding to various menus. Numeral 203 indicates a drawing data storage unit for storing drawing data 221. Numeral 204 indicates a drawing controller for searching for the drawing data 221 in accordance with the instruction from the state transition controller 201 and displaying the drawing data 221 on a display 205 for displaying maps, route guidance and menus.

A description will now be given of the operation of the related art image display apparatus.

Upon receipt of an instruction from another apparatus (for example, scroll buttons, a touch panel or other controllers) built in the on-vehicle navigation apparatus, the state transition controller 201 searches for the state transition data 211 in the state transition data storage unit 202 in accordance with the instruction. The state transition controller 201 selects the state transition data for the menu that should be displayed in accordance with the instruction.

The state transition controller 201 supplies the state transition data and detailed information relating to the display of the menu to the drawing controller 203 to instruct it to change the display. The detailed information relating to the display indicates the status of the menu being displayed. For example, when there are four items listed in the menu, the detailed information indicates which of the four items is being selected.

The drawing controller 204 searches for the drawing data 221 based on the instruction from the state transition controller 201 so as to select the drawing data 221 required to display the image requested by the instruction. The drawing controller 204 produces display data based on the selected drawing data and causes the menu to be displayed on the display 205.

In displaying a menu containing four items one of which is being displayed, the drawing controller 204 selects basic data of a menu in which none of the four items is being selected. The drawing controller 204 then selects the drawing data for showing the selection of the item and superimposes that data on the basic data so that the selection is indicated at an appropriate position. Thus, the image data for the menu is prepared.

Japanese Laid-Open Patent Application No. 10-261105 discloses another related-art technology for changing the displayed image based on the state transition data.

Design used in the display and procedures for a change of display may be modified depending upon the needs that arises during the development of the on-vehicle navigation apparatus having the related-art image display apparatus built in. Since the format and content of the state transition data 211 and the drawing data 221 are closely related to the functions of the state transition controller 201 and the drawing controller 204, not only the state transition data and the drawing data, but also part of the state transition controller 201 or the drawing controller 204 may have to be modified. This involves extensive changes in the design of the apparatus with the built-in image display apparatus so that the development thereof is delayed.

A change in the drawing data 221 may require a change in the manner of selection of the image data effected in the drawing controller 204. For example, due to an increase in the number of items for selection in the menu, a mathematical function used in the selection may have to be changed or the volume of the drawing data may have to be increased, requiring a change in the drawing controller 204.

A change in the state transition data 211 may require a change in the detailed information related to the menu and provided in the state transition controller 201. For example, when the procedure of using the menu is changed; i.e. when the state transition data 211 is changed, a method of storing the detailed information indicating the menu may have to be changed. In association with the change in the state transition data 211, the format of the state transition data may have to be changed so that a method of transferring data from the state transition controller 201 to the drawing controller 204 may have to be changed.

SUMMARY OF THE INVENTION

Accordingly, a general object of the present invention is to provide an image display apparatus and an image display method in which the aforementioned disadvantage is eliminated.

Another and more specific object is to provide an image display apparatus and an image display method in which the drawing data is broken down into graphic elements comprising basic elements and attributes thereof, and animation elements that describe a procedure for dynamic modification of the attributes of the graphic elements. The display of the menu composed of the graphic elements is changed based on the animation elements, and in which the state transition data and the drawing data can be modified without requiring a change in the state transition controller and the drawing controller.

The aforementioned objects can be achieved by an image display apparatus for changing a state of display in accordance with state transition data corresponding to a predetermined instruction, producing post-transition display data from drawing data, and displaying an image based on the display data, comprising: drawing data storage unit for storing drawing data including at least one graphic element and at least one animation element, the graphic element including a basic element of the image and attributes of the basic element, and the animation element being associated with the graphic element and describing a predetermined condition and a procedure for dynamically changing the attribute of the graphic element when the predetermined condition is fulfilled; and a drawing controller for executing the procedure described in the animation element so as to change the attribute of the graphic element, when the predetermined condition is fulfilled, and producing the display data based on the graphic element.

Accordingly, processes executed by the state transition controller and the drawing controller do not depend on a change in the state transition data or the drawing data. Thus, the state transition data and the drawing data can be changed without affecting the design of the state transition controller and the drawing controller.

The predetermined condition may be a condition related to a predetermined animation variable.

According to this aspect of the invention, the method of controlling the display of the image such as a menu comprising the graphic element can be simplified and the construction of the drawing controller is simplified.

The image display apparatus may further comprise a state transition controller for generating a change instruction for changing a value of the animation variable, from the state transition data corresponding to the predetermined instruction, wherein the drawing controller changes the value of the animation variable in accordance with the change instruction from the state transition controller, checks whether the predetermined condition described in the animation element is fulfilled, based on the changed value of the animation variable, and executes the procedure described in the animation element when the predetermined condition is fulfilled.

According to this aspect of the invention, the construction of the state transition controller is simplified.

The drawing controller may draw the image after producing the display data of the image as a whole from the graphic element.

According to this aspect of the invention, the image in the process of modification is not displayed so that the menu is changed instantly from the viewpoint of a user.

The drawing data storage unit may store the drawing data in a modifiable manner.

According to this aspect of the invention, when a change in the design of the menu is required, the required change can be effected by changing the drawing data, thus requiring a minimum change in the apparatus. When a change in the design of the menu is requested during the course of development of an on-vehicle navigation apparatus, for example, the development can proceed rapidly.

The image display apparatus may further comprise a state transition data storage unit for storing the state transition data in a modifiable manner.

According to this aspect of the invention, when a change is required only in the procedure of selection in the menu, the required change is effected by changing the state transition data, thus requiring a minimum change in the apparatus. When a change in the procedure for selection in the menu is requested during the course of development of an on-vehicle navigation apparatus, for example, the development can proceed rapidly.

The image display apparatus may further comprise a drawing data reading unit for reading drawing data recorded in a predetermined recording medium.

According to this aspect of the invention, the design of the menu can be changed easily by exchanging the recording medium for another medium also storing the drawing data.

The image display apparatus may further comprise a state transition data reading unit for reading state transition data recorded in a recording medium.

According to this aspect of the invention, the procedure for selection in the menu can be changed easily by exchanging the recording medium for another medium also storing the state transition data.

The image display apparatus may further comprise a data communication unit for communicating with a predetermined external apparatus so as to retrieve the state transition data.

According to this aspect of the invention, the state transition data can be modified using an external apparatus, providing convenience when the state transition data is to be frequently changed.

The drawing data storage unit may store a plurality of types of drawing data, and the drawing controller comprises a drawing data switching unit for selecting by switching the drawing data used in producing the display data, in accordance with the state transition data.

According to this aspect of the invention, efficiency of development of the apparatus is improved. More specifically, it is not necessary to change the entirety of the set of drawing data when a minor change is required in the drawing data in the course of developing the apparatus. Only the drawing data corresponding to the required change has to be changed. Development of the apparatus relative to the drawing data can proceed in a manner independent of the other drawing data.

The drawing data storage unit may store, for each drawing data, auxiliary drawing data comprising one of color information and image element of the drawing data, and the drawing controller produces the display data using the auxiliary drawing data corresponding to the drawing data selected by the drawing data switching unit.

Accordingly, a relative extensive range of colors can be used to produce display data and a variety of drawing elements can be used.

The image display apparatus may further comprise: a state transition storage unit for storing a plurality of state transition data; a state transition controller for changing the state of display, based on one of the plurality of types of state transition data; state transition data switching unit for selecting by switching the state transition data used by the state transition controller, in accordance with the instruction or the state of display.

According to this aspect of the invention, when a minor change is required in the state transition data during the course of development of the apparatus, the entirety of the state transition data need not be changed. Of the plurality of types of transition data, only the state transition data corresponding to the required changed need be changed. Therefore, the efficiency of development is improved.

The aforementioned objects can be achieved by an image display method for changing a state of display in accordance with state transition data corresponding to a predetermined instruction, producing post-transition display data from drawing data, and displaying an image based on the display data, comprising the steps of: determining whether a condition for a change in the state of display is fulfilled, given drawing data including at least one graphic element and at least one animation element, the graphic element including a basic element of the image and attributes of the basic element, and the animation element being associated with the graphic element and describing a predetermined condition and a procedure for dynamically changing the attribute of the graphic element when the predetermined condition is fulfilled, the determination being done by determining whether the predetermined condition is fulfilled; and executing the procedure described in the animation element so as to change the attribute of the graphic element, when the predetermined condition is fulfilled; and producing the display data based on the graphic element.

BRIEF DESCRIPTION OF THE DRAWINGS

Other objects and further features of the present invention will be apparent from the following detailed description when read in conjunction with the accompanying drawings, in which.

DETAILED DESCRIPTION OF THE PREFERRED EMBODIMENTS

First Embodiment

Figure 1:
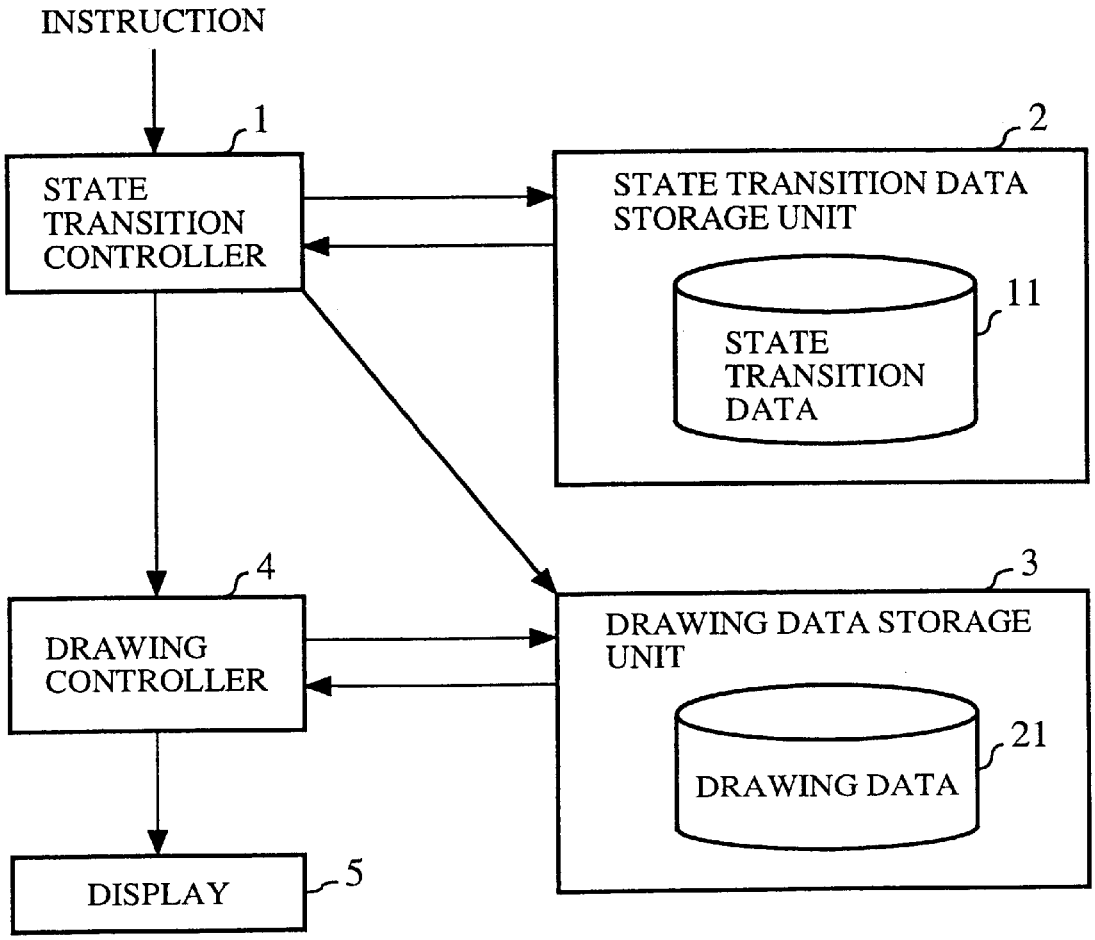
FIG. 1 is a block diagram showing a construction of an image display apparatus according to a first embodiment of the present invention.
Figure 2:
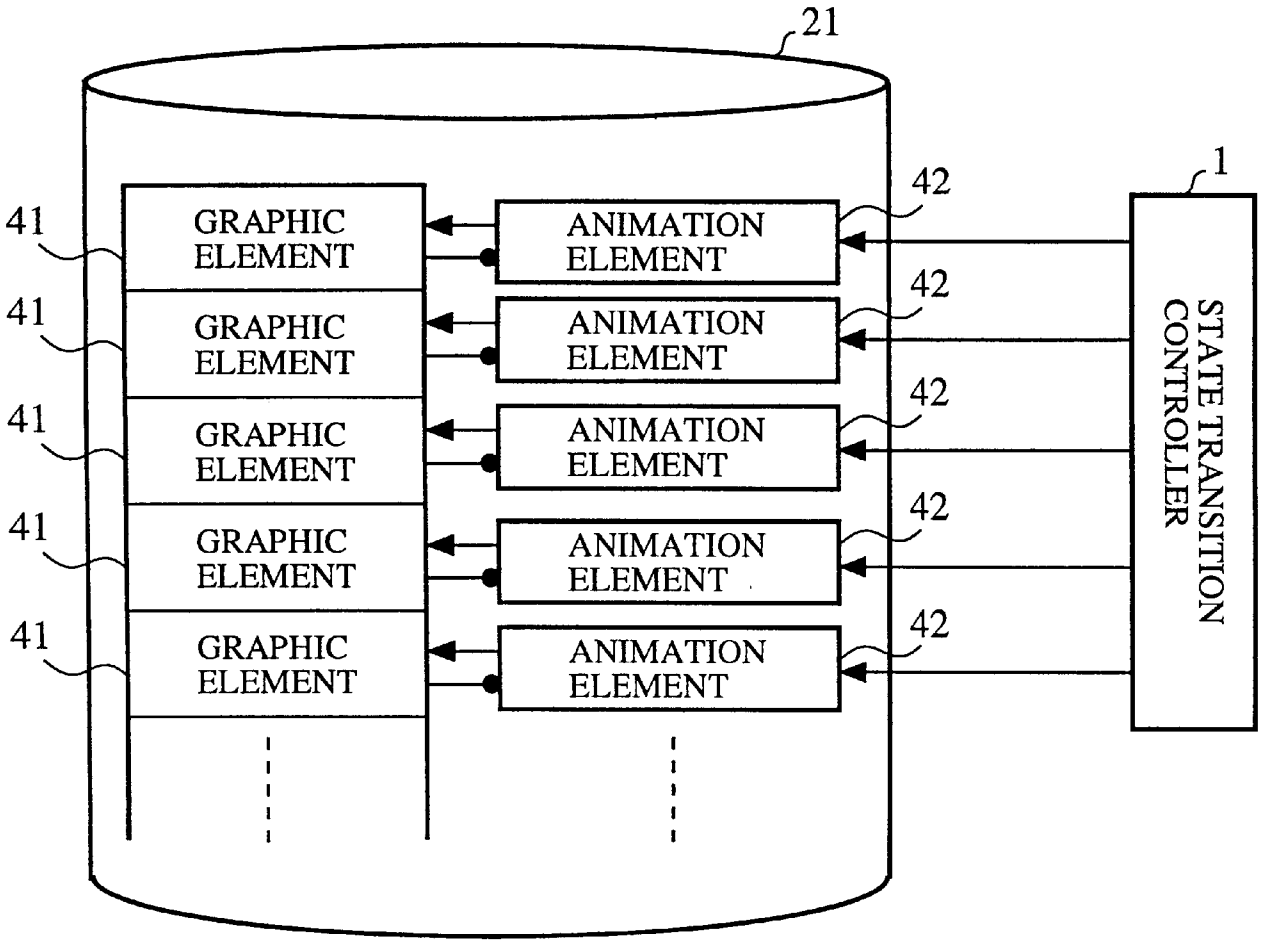
FIG. 2 shows an example of drawing data stored in a drawing data storage unit of the image display apparatus of FIG. 1.
Figure 3:
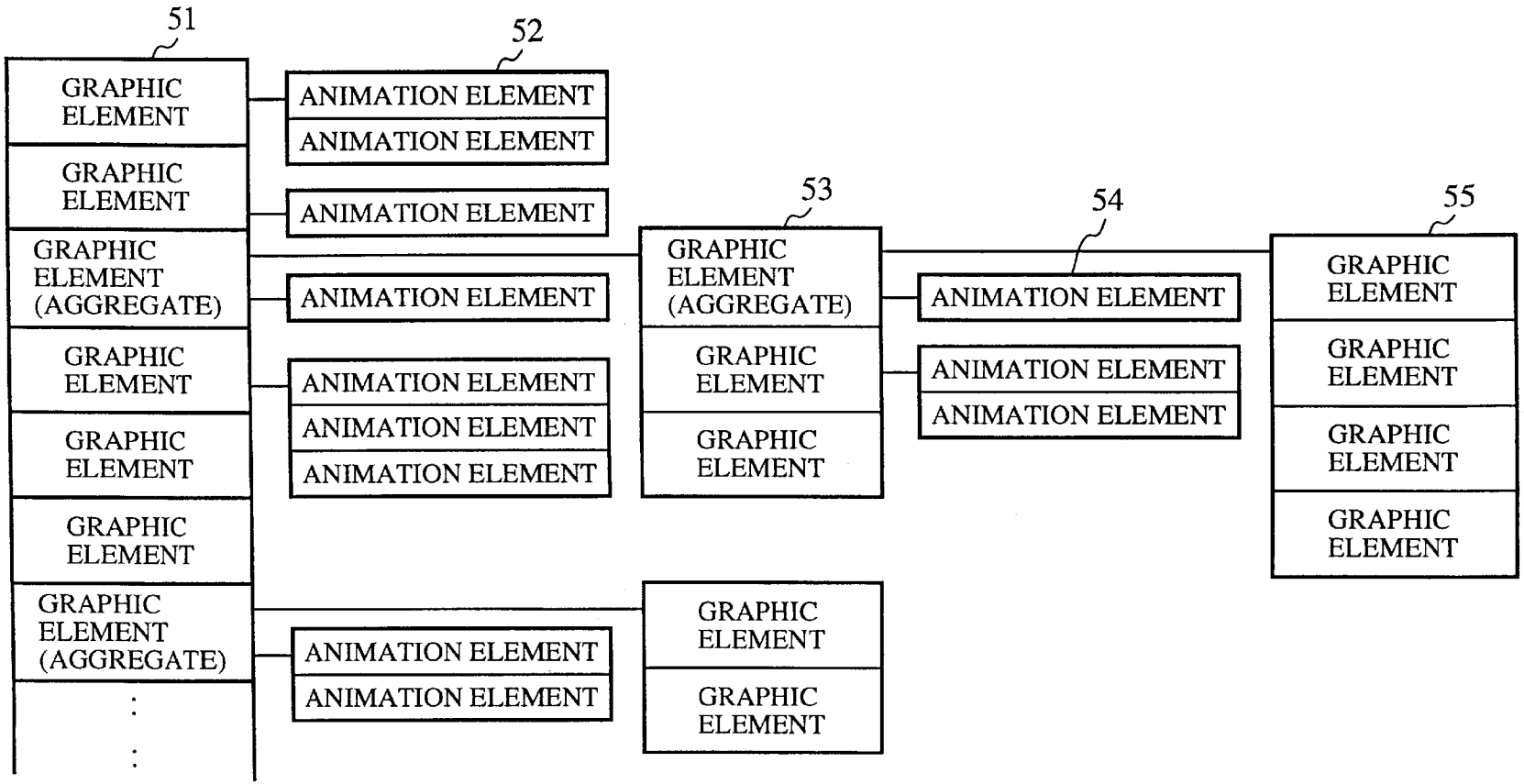
FIG. 3 shows another example of drawing data stored in the drawing data storage unit of the image display apparatus of FIG. 1.

FIG. 1 is a block diagram showing a construction of an image display apparatus according to a first embodiment of the present invention. For example, the image display apparatus is built into the on-vehicle navigation apparatus. FIG. 2 shows an example of drawing data stored in a drawing data storage unit 3 of the image display apparatus of FIG. 1. FIG. 3 shows another example of drawing data stored in the drawing data storage unit 3 of the image display apparatus of FIG. 1.

Referring to FIG. 1, numeral 1 indicates a state transition controller receiving a instruction from another apparatus built in the on-vehicle navigation apparatus, searching for state transition data 11 based on the instruction and supplying an instruction for modification of display based on the state transition data to a drawing controller 4. Numeral 2 indicates a state transition data storage unit for storing the state transition data 11 corresponding to various menus. Numeral 3 indicates a drawing data storage unit for storing drawing data 21. Numeral 4 indicates a drawing controller for searching for the drawing data 21 in accordance with the instruction from the state transition controller 1 and displaying the drawing data 21 on a display 5 for displaying maps, route guidance and menus.

Referring to FIG. 2, numeral 41 indicates a graphic element forming part of the drawing data 21. A graphic element is data for a basic element constituting a menu such as a straight line, a line, with several straight segments a polygon, a circle, an ellipse, a predetermined character string and a predetermined image. The graphic element 41 is stored in the form of a list as shown in FIG. 2. In addition to the data for the basic element, the graphic element 41 includes data indicating a position of display, a size and a color drawn.

As shown in FIG. 3, the graphic element 41 may be formed as an aggregate that contains a plurality of graphic elements and corresponding animation elements (described later) in the form of a list. By employing a nesting construction, a complicated graphic element may be built from basic elements. The drawing data 21 shown in FIG. 3 comprises a top-layer graphic element 51 and a associated animation element 52, a second-layer graphic element 53 forming an aggregate with the top-layer graphic element 51 and an associated animation element 54, and a third-layer graphic element 55.

Referring back to FIG. 2, numeral 42 indicates an animation element comprising a set of animation element items that describe procedures for dynamically modifying attributes of the associated graphic element 41. More specifically, the animation element describes procedures for switching to a display state or a non-display state, changing of a position of display (movement), enlarging/reduction (size change), rotation, change in color, as well as describing a preset condition under which these procedures are triggered. As shown in FIG. 2, the animation element attached to the graphic element is stored in the form of a list. The preset condition described in the animation element may be stored as part of the drawing data. Alternatively, the state transition controller 1 may set the preset condition in accordance with the state transition data.

The animation element is a description of the procedures for changing the attribute of the graphic element. The animation element is not attached to the graphic element having attributes that need not be changed. In contrast, a plurality of animation elements are attached to the graphic element having a plurality of attributes that need to be changed. When different procedures should be triggered depending on different conditions for a given graphic element, that graphic element may also have a plurality of animation elements of the same kind attached thereto.

A description will now be given of the operation.

Upon receipt of an instruction from another apparatus (for example, scroll buttons, a touch panel or other controllers) built in the on-vehicle navigation apparatus, the state transition controller 1 searches for the state transition data 11 in the state transition data storage unit 2 in accordance with the instruction. The state transition controller 1 selects the state transition data for the menu that should be displayed in accordance with the instruction. The state transition controller 1 supplies the state transition data to the drawing controller 4 to instruct it to change the display in accordance with the state transition data.

According to the first embodiment, the drawing controller 4 is designed to determine whether the condition set in the animation element 42 is valid, based on a value of an parameter called an animation variable. The state transition controller 1 supplies the instruction to change the display to the drawing controller 4 in the form of an instruction to change a value of the animation variable. The animation element describes a condition for determining that the value of the animation variable is a predetermined value, or a condition for determining that the value of the animation variable is within a predetermined range. The animation variable may be provided in each animation element. Alternatively, the same animation variable may be used for a plurality of animation elements. A plurality of animation variables may be used for an animation element.

The drawing controller 4 receiving the instruction to change the value of the animation variable changes the value of the animation variable in accordance with the instruction. The drawing controller 4 then determines whether the condition described in the animation element 42 is fulfilled based on the value of the animation variable. For the animation element 42 using the condition associated with the animation variable that is changed, the result of determination as to the condition may be changed as a result of the instruction. When the result of determination as to the condition is changed, the procedure described in that animation element is triggered to affect the graphic element having that animation element attached so that the image of the menu on the display 5 is changed.

In the case of an animation element item for switching between a display state and a non-display state (blinking animation), drawing of the graphic element corresponding to that animation element item is enabled when the preset condition is fulfilled. If the preset condition is not fulfilled, drawing of the graphic element corresponding to the animation element is disabled.

If the graphic element corresponding to the animation element item for switching between a display state and a non-display state is an aggregate, drawing of the entire graphic elements belonging to the aggregate is enabled when the preset condition is fulfilled. When the condition is not fulfilled, drawing of the entire graphic elements belonging to the aggregate is disabled.

In the case of an animation element item for movement (moving animation), positions (x, y) of display of the graphic element corresponding to that animation element item are updated by a predefined distance ($\Delta x$, $\Delta y$) when the preset condition is fulfilled. When the condition is not fulfilled, the positions (x, y) of display of the graphic element remain unchanged.

In the case of an animation element item for enlarging/reduction (enlarged/reduced animation), the width w and the height h of the graphic element corresponding to that animation element item are updated to preset values w1 and h1, respectively, when the preset condition is fulfilled. When the condition is not fulfilled, the size of display of the graphic element remains unchanged.

In the case of an animation element item for rotation (rotated animation), the shape of the graphic element corresponding to that animation element item is changed by being rotated by an angle $\phi\ \Delta$ around a predetermined center at (x0, y0) when the preset condition is fulfilled. When the preset condition is not fulfilled, the shape of the graphic element remains unchanged.

In the case of an animation element item for color change (variable color animation), the color with which the graphic element corresponding to that animation element is drawn is changed to a predetermined color, when the preset condition is fulfilled. When the preset condition is not fulfilled, the color of the graphic element remains unchanged.

A description will now be given of details of a process for displaying a menu performed by the drawing controller 4.

Figure 4:
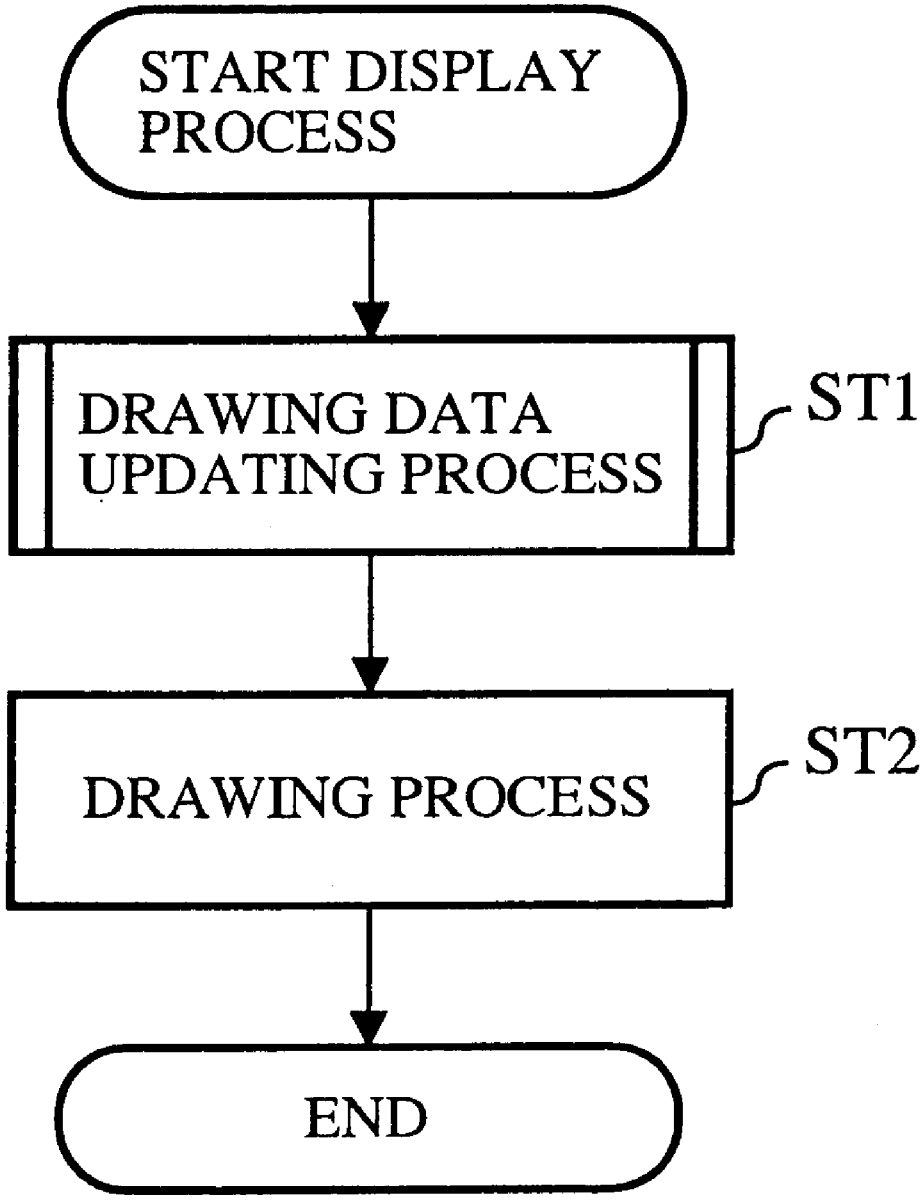
FIG. 4 is a flowchart showing a menu display process.

FIG. 4 is a flowchart that shows the process for displaying the menu. FIG. 5 is a flowchart that shows details of a drawing data updating process and a drawing process of FIG. 4.

After updating the animation variable responsive to the instruction from the state transition controller 1, the drawing controller 4 executes in step ST1 a drawing data updating process for updating the drawing data to reflect the instruction from the state transition controller 1.

Figure 5B:
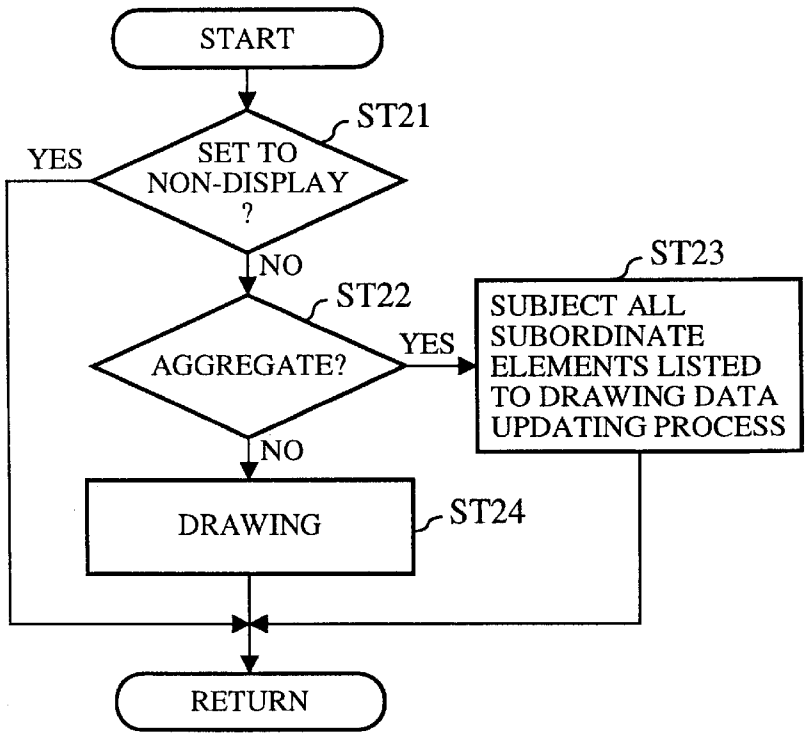
FIG. 5B is a flowchart that shows details of a drawing process of FIG. 4.
Figure 5A:
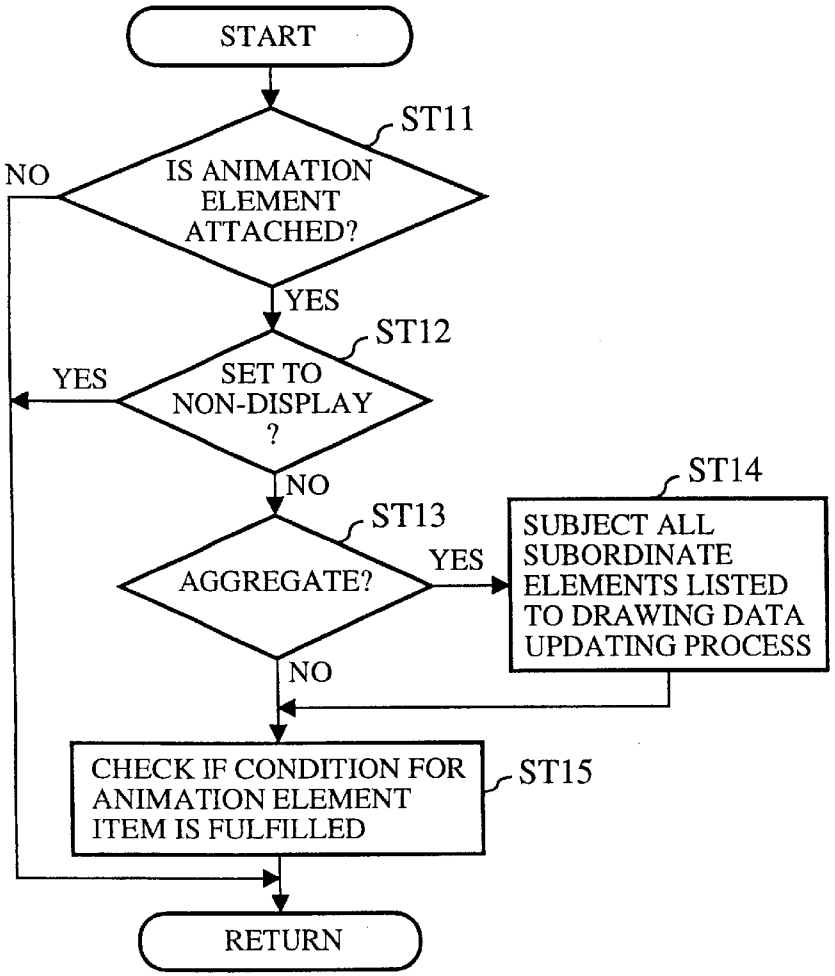
FIG. 5A is a flowchart that shows details of a drawing data updating process of FIG. 4.

FIG. 5A is a flowchart that shows details of a drawing data updating process of FIG. 4; and FIG. 5B is a flowchart that shows details of a drawing process of FIG. 4. Referring to FIG. 5A, the drawing controller 4 starts the process at the top-layer graphic element 51. The drawing controller 4 determines in step ST11, whether the graphic element (in this case, the graphic element 51) subject to the process has an animation element item attached thereto. If it is determined that the graphic element subject to the process has an animation element item attached thereto, a determination is made in step ST12 as to whether the animation element item is related to display/non-display and whether the corresponding animation variable has a value indicating a non-display state.

If it is determined that the animation variable does not have a value indicating a non-display state, the drawing controller 4 determines in step ST14 whether the graphic element is an aggregate. If the graphic element is not an aggregate, the drawing controller 4 checks whether the condition for the animation element item is fulfilled. Depending on the result of checking, the drawing controller 4 updates attributes of the graphic element in accordance with the procedure described in the animation element, thereby produces display data corresponding to the graphic element.

If it is determined in step ST11 that no animation element items are not attached, or if it is determined in step ST12 that the animation element item is not related to display/non-display, or that the animation variable indicates a non-display state, the process for the target graphic element is terminated.

If it is determined in step ST13 that the graphic element is an aggregate, the drawing controller 4 recursively executes in step ST14 the drawing data updating process (step ST1) for the graphic element immediately below the top layer.

The process described above is continued through the graphic element in the bottom layer listed.

In step ST2 of FIG. 4, the drawing controller 4 executes the drawing process based on the display data produced in step ST1. Referring to FIG. 5B, the drawing controller 4 starts the drawing process at the top-layer graphic element 51. In step ST21, the drawing controller 4 determines whether the animation element item is related to display/non-display and the corresponding animation variable has a value indicating a non-display state.

If it is determined that the animation variable does not indicate a non-display state, the drawing controller 4 then determines in step ST22 whether the graphic element is an aggregate. If the graphic element is not an aggregate, the drawing controller 4 draws, in step ST24, the graphic element based on the display data produced in step ST1.

If it is determined in step ST21 that the animation element item is not related to display/non-display or that the animation variable indicates a non-display state, the process for the graphic element is terminated.

If it is determined in step ST22 that the graphic element is an aggregate, the drawing controller 4 recursively executes in step ST23 the drawing process (step ST2) for the graphic element immediately below the top layer.

The process described above is continued through the graphic element in the bottom layer listed.

Thus, the image of the menu in compliance with the instruction from the state transition controller 1 is provided to the display 5.

According to the first embodiment, the drawing data is designed to comprise graphic elements formed of basic elements and attributes thereof and animation elements describing procedures for dynamically modifying the attributes of the graphic elements. The displayed image of the menu composed of graphic elements is modified based on the animation element. The method of process performed by the state transition controller 1 and the drawing controller 4 do not depend on a change in the state transition data and the drawing data. Accordingly, the state transition data and the drawing data can be changed without changing the state transition controller 1 or the drawing controller 4.

In further accordance with the first embodiment, a determination is made as to whether or not a procedure described in the animation element is executed, based on the animation variable. Accordingly, the method of controlling the display of the menu composed of graphic elements is simplified and the construction of the drawing controller 4 is simplified.

In still further accordance with the first embodiment, the state transition controller 1 generates an instruction to change the value of the animation variable, based on the transition data, so as to supply the instruction to the drawing controller 4. Accordingly, the construction of the state transition controller 1 is simplified.

In still further accordance with the first embodiment, the drawing process for the menu is executed after producing the display data for the entirety of the menu from the graphic elements. Accordingly, the image in the process of modification is not displayed so that the menu is changed instantly from the viewpoint of a user.

Second Embodiment

The image display apparatus according to a second embodiment is constructed such that the drawing data 21 can be modified. In the second embodiment, the drawing data storage unit 3 is composed of a non-volatile memory or a magnetic recording medium. The drawing data 21 in the drawing data storage unit 3 is modified by an external apparatus (not shown).

According to the second embodiment, when a change is required only in the design of the menu, the required change can be effected by changing the drawing data 21, thus requiring a minimum change in the apparatus. When a change in the design of the menu is requested during the course of development of an on-vehicle navigation apparatus, for example, the development can proceed rapidly.

Third Embodiment

The image display apparatus according to a third embodiment is constructed such that the state transition data 11 can be modified. In the second embodiment, the state transition storage unit 2 is composed of a non-volatile memory or a magnetic recording medium. The state transition data 11 in the state transition data storage unit 2 is modified by an external apparatus (not shown).

According to the third embodiment, when a change is required only in the procedure of selection in the menu, the required change is effected by changing the state transition data 11, thus requiring a minimum change in the apparatus. When a change in the procedure for selection in the menu is requested during the course of development of an on-vehicle navigation apparatus, for example, the development can proceed rapidly.

Fourth Embodiment

Figure 6:
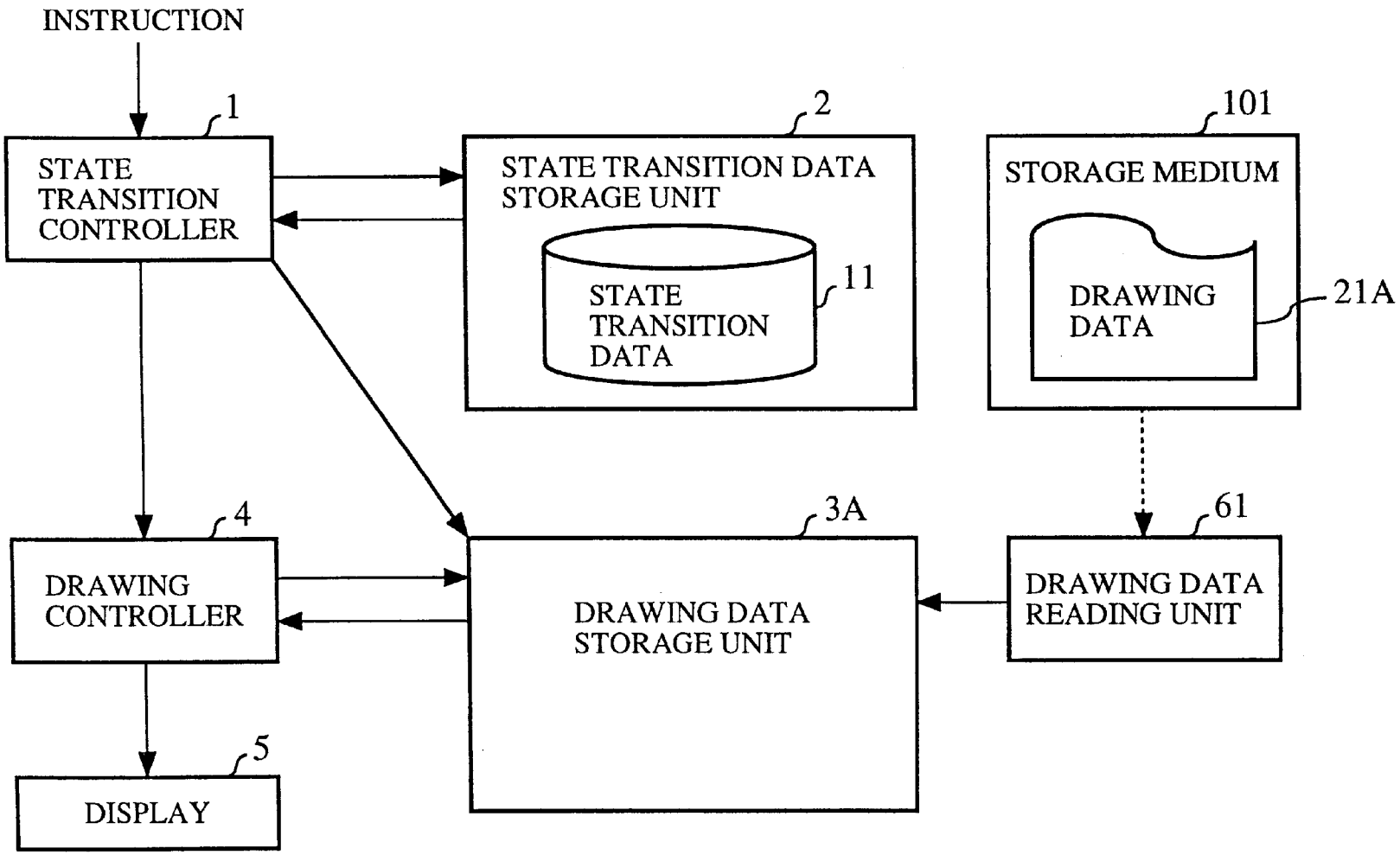
FIG. 6 is a block diagram showing a construction of an image display apparatus according to a fourth embodiment of the present invention.

FIG. 6 is a block diagram showing a construction of an image display apparatus according to a fourth embodiment of the present invention. Referring to FIG. 6, numeral 3A indicates a drawing data storage unit for storing drawing data 21A supplied from a drawing data reading unit 61. Numeral 61 indicates a drawing data reading unit for reading the drawing data 21A from a recording medium 101 and supplying the drawing data 21A to the drawing data storage unit 3A. Numeral 101 indicates a recording medium such as a CD-ROM in which the drawing data 21A is stored. The drawing data storage unit 3A may store default drawing data.

The other components shown in FIG. 6 are the same as the corresponding components according to the first embodiment shown in FIG. 1 and the description thereof is omitted.

A description will now be given of the operation according to the second embodiment.

The drawing data reading unit 61 reads the drawing data 21A recorded in the recording medium 101 in a predetermined format, analyzes the drawing data 21A, converts the drawing data 21A into a predetermined format and then supplies the converted data to the drawing data storage unit 3A. The drawing data storage unit 3A stores the drawing data thus supplied.

The other aspects of the operation are the same as the corresponding aspects according to the first embodiment shown in FIG. 1 and the description thereof is omitted.

By providing the drawing data reading unit 61 for reading the drawing data from the recording medium 101 and supplying the data to the drawing data storage unit 3A, the design of the image such as the menu can be changed easily by exchanging the recording medium 101 for another medium also storing the drawing data 21A.

Fifth Embodiment

Figure 7:
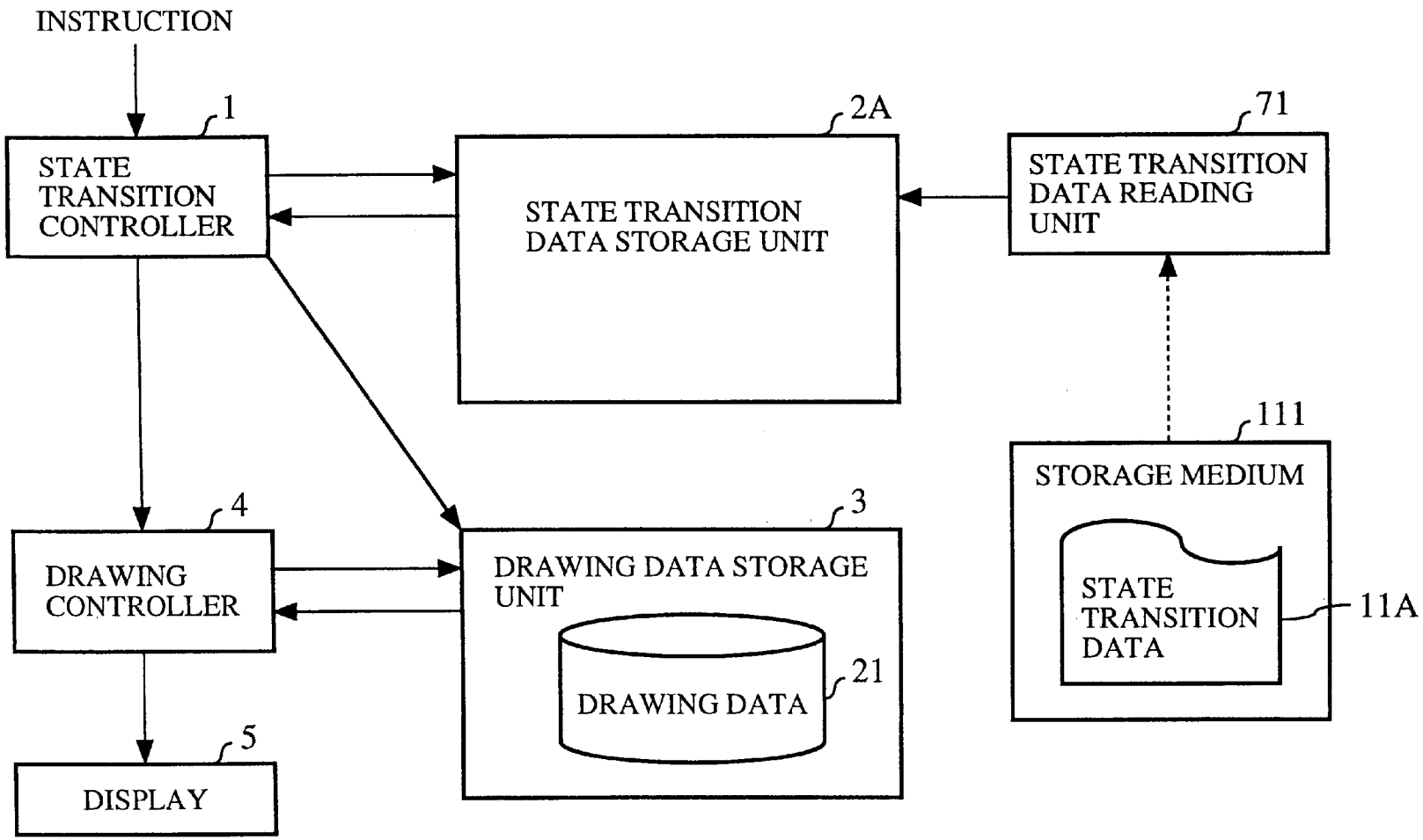
FIG. 7 is a block diagram showing a construction of an image display apparatus according to a fifth embodiment of the present invention.

FIG. 7 is a block diagram showing a construction of an image display apparatus according to a fifth embodiment of the present invention. Referring to FIG. 7, numeral 2A indicates a state transition data storage unit for storing storage data 11A supplied from a state transition data reading unit 71. Numeral 71 indicates a state transition data reading unit for reading the state transition data 11A from a recording medium 111 and supplying the data to the state transition data storage unit 2A. Numeral 111 indicates a recording medium such as a CD-ROM in which the state transition data 11A is recorded. The state transition data storage unit 2A may store default state transition data.

The other components shown in FIG. 7 are the same as the corresponding components according to the first embodiment shown in FIG. 1 and the description thereof is omitted.

A description will now be given of the operation according to the fifth embodiment.

The state transition data reading unit 71 reads, at a start-up of the apparatus or at appropriate occasions, the state transition data 11A recorded in the recording medium 111 in a predetermined format, analyzes the state transition data 11A, converts the state transition data 11A into a predetermined format and then supplies the converted data to the state transition data storage unit 2A. The state transition data storage unit 2A stores the state transition data thus supplied.

The other aspects of the operation are the same as the corresponding aspects according to the first embodiment shown in FIG. 1 and the description thereof is omitted.

By providing the state transition data reading unit 71 for reading the state transition data from the recording medium 111 and supplying the data to the state transition data storage unit 2A, the procedure for selection in the menu can be changed easily by exchanging the recording medium 111 for another medium also storing the state transition data 11A.

Sixth Embodiment

Figure 8:
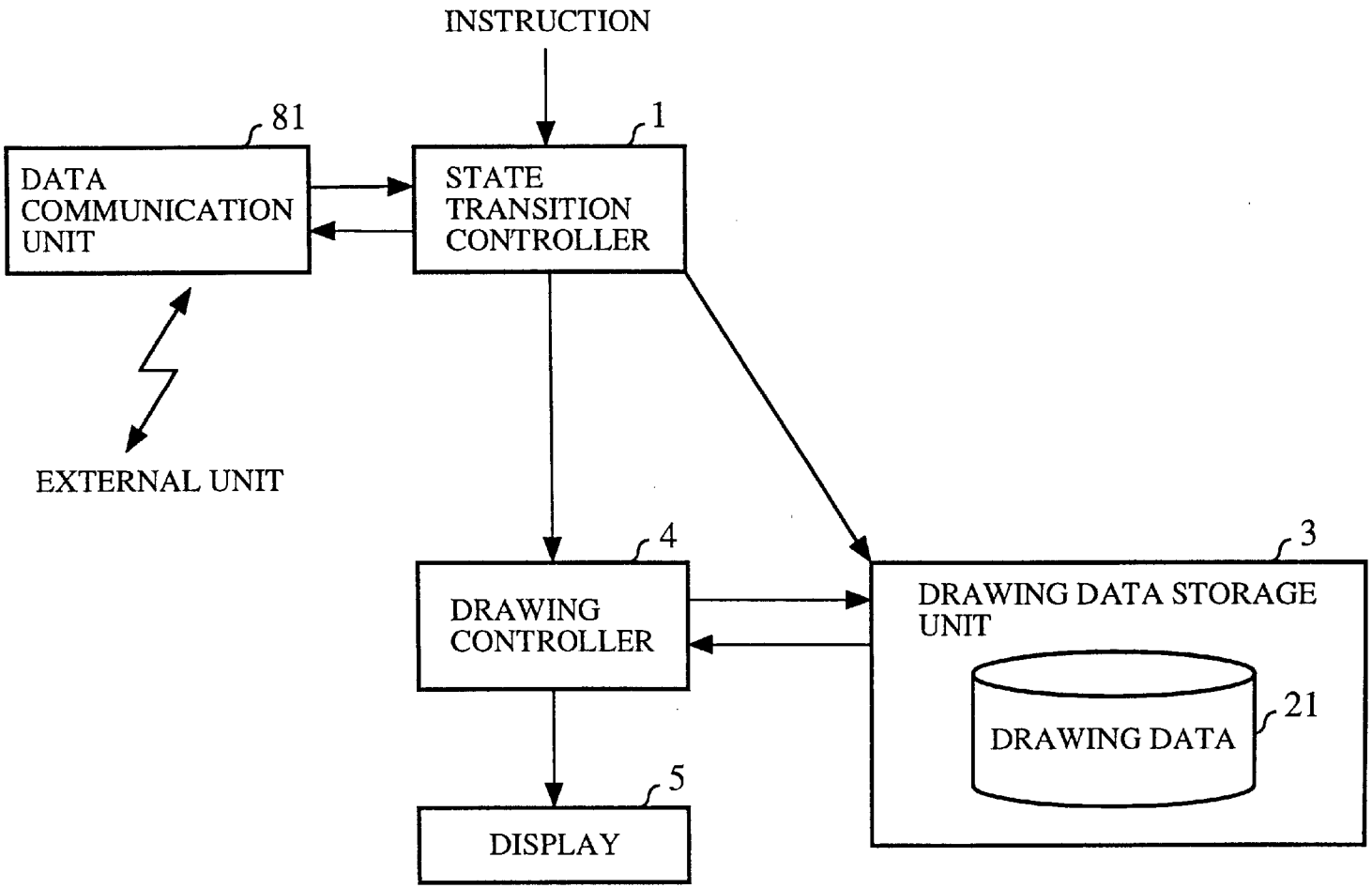
FIG. 8 is a block diagram showing a construction of an image display apparatus according to a sixth embodiment of the present invention.

FIG. 8 is a block diagram showing a construction of an image display apparatus according to a sixth embodiment of the present invention. Referring to FIG. 8, numeral 81 indicates a data communication unit for communicating with an external apparatus (not shown) via a predetermined channel and supplying the state transition data stored in the external apparatus to the state transition controller 1.

The other components shown in FIG. 8 are the same as the corresponding components according to the first embodiment shown in FIG. 1 and the description thereof is omitted. The state transition data storage unit 2 may store the default state transition data.

A description will now be given of the operation according to the sixth embodiment.

Upon receipt of the instruction from another apparatus (not shown), the state transition controller 1 controls the data communication unit 81 so as to collect the state transition data corresponding to the instruction and generate the instruction to change the animation element, based on the state transition data.

The other aspects of the operation are the same as the corresponding aspects according to the first embodiment shown in FIG. 1 and the description thereof is omitted.

By providing the data communication unit 81 to collect the state transition data, the state transition data can be modified using an external apparatus.

Seventh Embodiment

Figure 9:
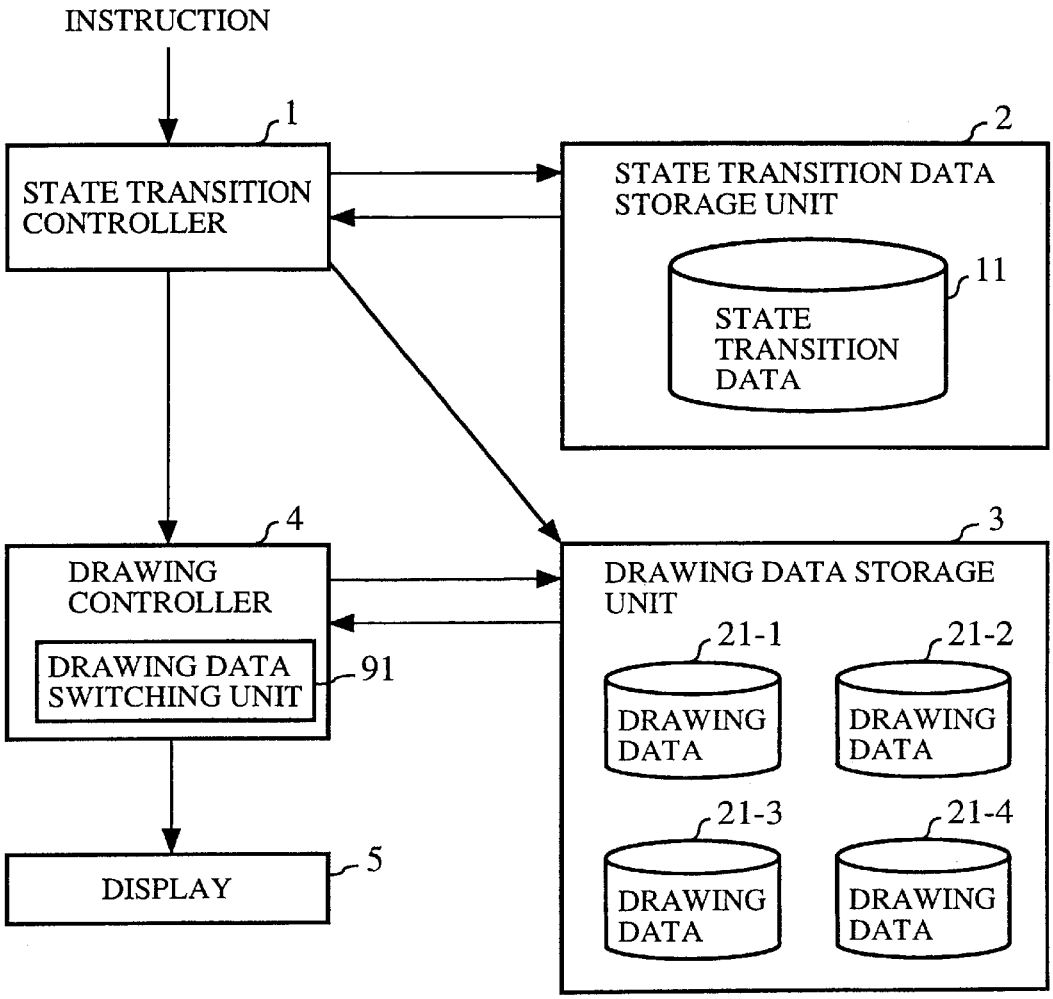
FIG. 9 is a block diagram showing a construction of an image display apparatus according to a seventh embodiment of the present invention.

FIG. 9 is a block diagram showing a construction of an image display apparatus according to a seventh embodiment of the present invention. Referring to FIG. 9, numerals 21-1–21-4 indicate drawing data of a plurality of types stored in the drawing data storage unit 3. Numeral 91 indicates a drawing data switching unit for switching between the drawing data to select the data used in preparing display data, in accordance with the state transition data. The other components shown in FIG. 9 are the same as the corresponding components according to the first embodiment shown in FIG. 1 and the description thereof is omitted.

A description will now be given of the operation according to the seventh embodiment.

According to the seventh embodiment, the drawing controller 4 controls the built-in drawing data switching unit 91 to read the drawing data 21-i (i=1, . . . , or 4) from the drawing data storage unit 3. The drawing data 21-i thus read is used to prepare display data. The other aspects of the operation are the same as the corresponding aspects of the first embodiment and the description thereof is omitted.

By storing the drawing data 21-1–21-4 of a plurality of types in the drawing data storage unit 3, and switching between the drawing data to select the data used in preparing display data, efficiency of development of the apparatus is improved. More specifically, it is not necessary to change the entirety of the set of drawing data when a minor change is required in the drawing data in the course of developing the apparatus. Only the drawing data corresponding to the required change has to be changed. Development of the apparatus relative to the drawing data 21-i can proceed in a manner independent of the other drawing data 21-i.

More specifically, a requirement for a change in an arrangement of buttons in the menu or addition or deletion of buttons may arise during the course of development of a menu screen of an on-vehicle navigation apparatus. The seventh embodiment ensures that only the drawing data corresponding to the menu concerned need be changed.

The seventh embodiment is similar to the fourth embodiment in that, when the drawing data is read from the recording medium 101, the volume of data read is controlled when only a minor change is required in the drawing data. Accordingly, the drawing data can be modified efficiently.

Eighth Embodiment

Figure 10:
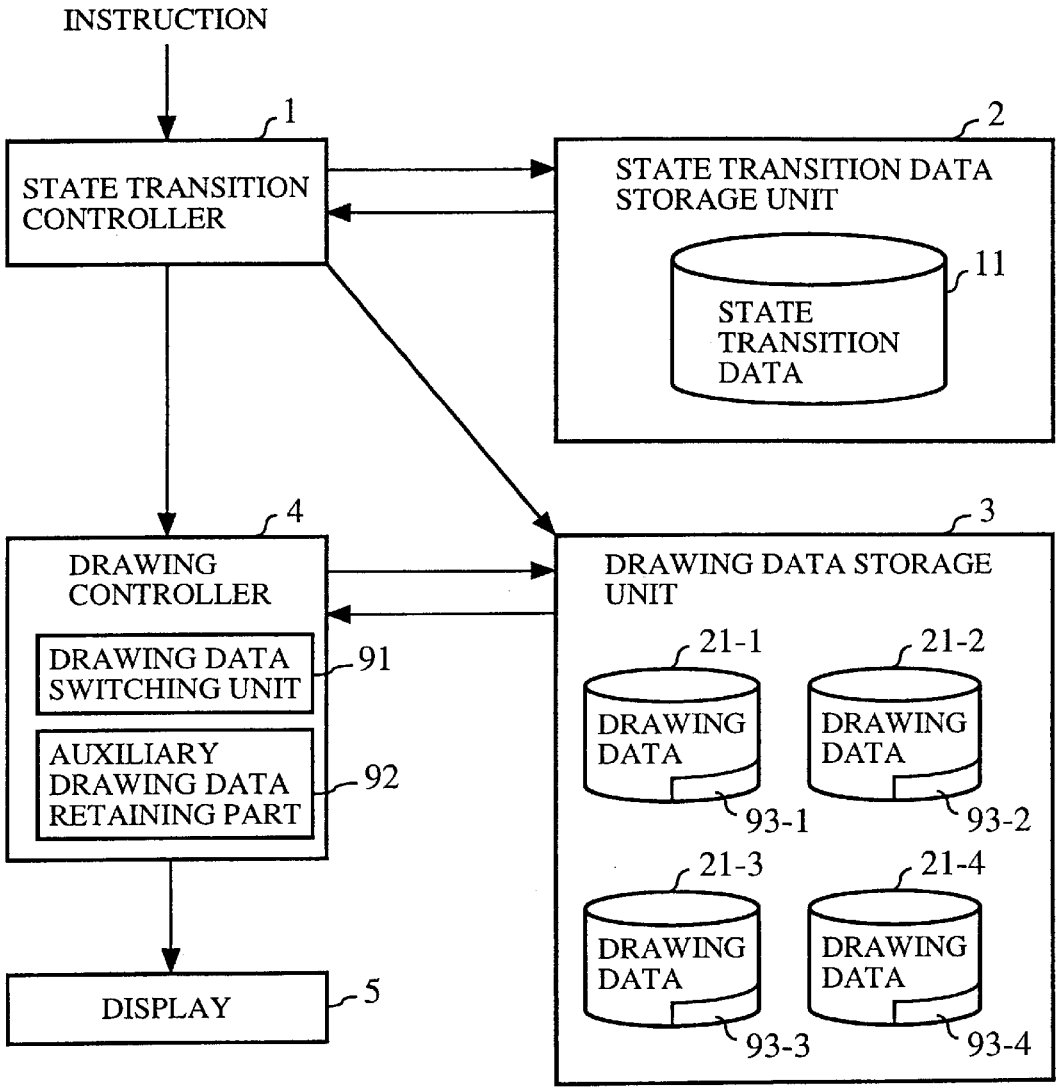
FIG. 10 is a block diagram showing a construction of an image display apparatus according to an eighth embodiment of the present invention.

FIG. 10 is a block diagram showing a construction of an image display apparatus according to an eighth embodiment of the present invention. Referring to FIG. 10, numerals 93-1–93-4 indicate auxiliary drawing data including color information of the drawing data and image elements such as bitmap data. The auxiliary drawing data is stored in the drawing data storage unit 3 to correspond to the drawing data 21-i. Numeral 92 indicates auxiliary drawing data retaining part for retaining the auxiliary drawing data corresponding to the drawing data selected by the drawing data switching unit 91. The other components shown in FIG. 10 are the same as the corresponding components according to the seventh embodiment shown in FIG. 9 and the description thereof is omitted.

A description will now be given of the operation according to the eighth embodiment.

According to the eighth embodiment, the drawing controller 4 controls the built-in drawing data switching unit 91 to read the drawing data 21-i (i=1, . . . 4) from the drawing data storage unit 3, in accordance with the instruction from the state transition controller 1. The selected drawing data 21-i is used in preparing display data. The drawing controller 4 stores the auxiliary drawing data corresponding to the selected drawing data in the auxiliary drawing data retaining part 92. The drawing controller 4 prepares the display data using the drawing data and the auxiliary drawing data. The other aspects of the operation are the same as the corresponding aspects according to the seventh embodiment shown in FIG. 9 and the description thereof is omitted.

When an image is drawn in an on-vehicle navigation apparatus, color information is required. For example, a polygonal line or a circle must have associated color information. The more colors are used, the more beautiful the displayed image is. However, the number of colors displayable on the display 5 is limited. Data drawn on the display 5 of the on-vehicle navigation apparatus is written dot by dot by the drawing controller 4 to a drawing data area of the memory. Each dot is displayed with a color corresponding to a value attached to the drawing area. A palette listing the correspondence between the value attached to the drawing data area and the displayed color. For example, when a total of 256 colors are used, color numbers 0–256 are respectively assigned to the 256 colors. For each color number, a set of red, green and blue gradation levels is preset. The richer the gradation, the more colors can be presented. For example, when there are 32 gradation levels are available, set of red, green and blue gradation levels (1, 11, 21) may be assigned to color number 0; and a set of red, green and blue gradation levels (31, 15, 23) is assigned to color number 1. Thus, the palette stores the correspondence between the color number and the red, green and blue gradation levels. The palette is stored as the auxiliary drawing data 93-1–93-4 in the drawing data storage unit 3 in association with the drawing data.

In addition to simple graphics such as polygonal lines and circles, drawing elements of the on-vehicle navigation apparatus may include bitmaps such as icons and marks. By using these extra drawing elements as auxiliary drawing data in addition to the aforementioned palette, the screen of the on-vehicle navigation apparatus is recognized more readily. The extra drawing element is composed of color data for each of dots arranged in a two-dimensional matrix (for example, a 16×16 square containing 256 dots). Accordingly, when the extra drawing element is drawn, the aforementioned palette is used.

Thus, according to the eighth embodiment, the auxiliary drawing data 93-1–93-4 representing color information (palette) of the drawing data is stored in the drawing data storage unit 3 in association with the drawing data 21-i. By using the auxiliary drawing data corresponding to the drawing data selected by the drawing data switching unit 91 is used to produce display data. Accordingly, a relative extensive range of colors can be used to produce display data and a variety of drawing elements can be used.

In the case of 256 colors, a memory capacity of 1 byte is necessary for each dot. When the number of colors registered in the palette is increased, the capacity of the memory required to retain the palette is increased. By providing a palette for each drawing data, a variety of colors can be used without increasing the capacity of the memory to hold the palette. Since a large number of colors can be used in this embodiment, the variety of drawing elements is increased.

It is assumed in the seventh and eighth embodiments that four types of drawing data are stored in the drawing data storage unit 3. However, a desired number of types of drawing data may be stored.

Ninth Embodiment

Figure 11:
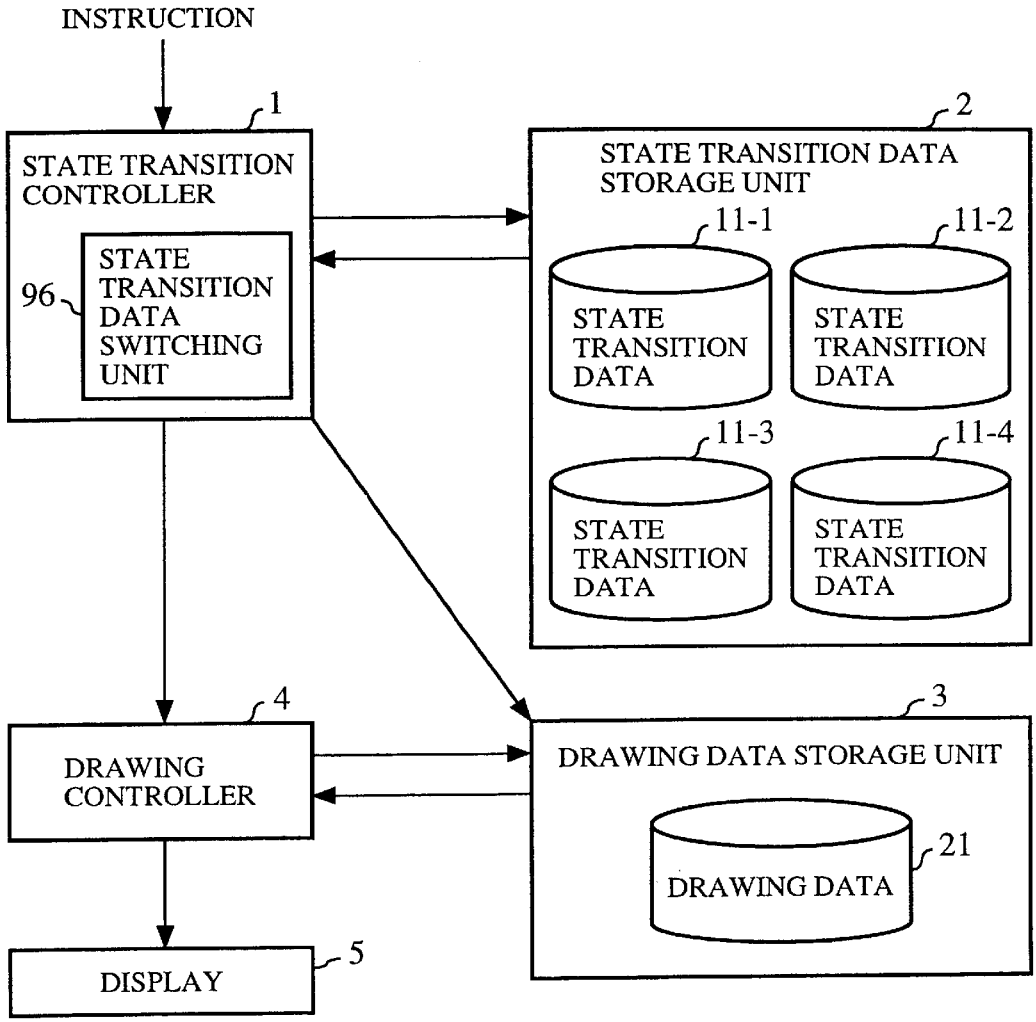
FIG. 11 is a block diagram showing a construction of an image display apparatus according to a ninth embodiment of the present invention.
Figure 12:
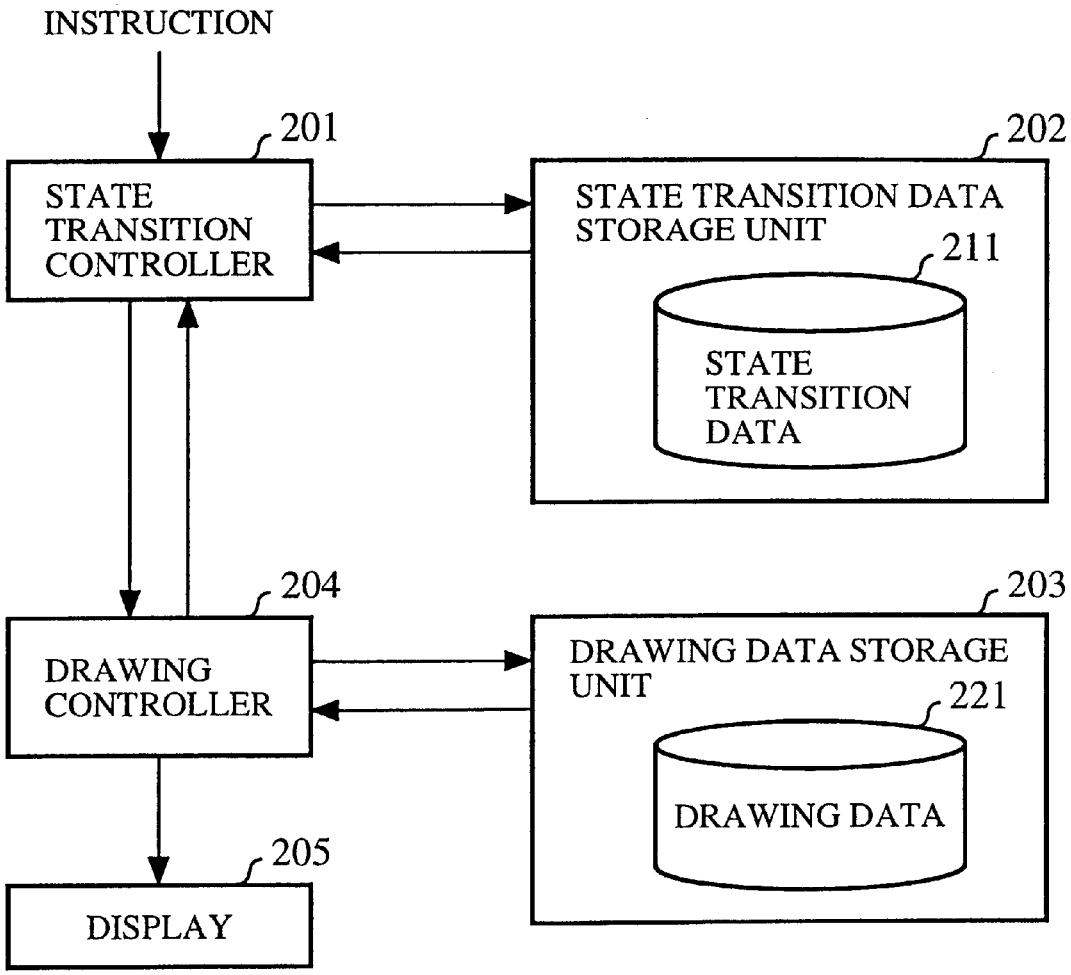
FIG.12 (PRIOR ART)
FIG. 12 is a block diagram showing a construction of an image display apparatus according to the related art.

FIG. 11 is a block diagram showing a construction of an image display apparatus according to a ninth embodiment of the present invention. Referring to FIG. 11, numerals 11-1–11-4 indicate a plurality of types of transition data. Numeral 96 indicates a transition data switching unit for switching between transition data used by the state transition controller 1. The other components shown in FIG. 11 are the same as the corresponding components of the first embodiment shown in FIG. 1 and the description thereof is omitted.

A description will now be given of the operation of the ninth embodiment. The state transition controller 1 reads out the state transition data 11-i (i=1, . . . 4) from the state transition data storage unit 2 in accordance with a predetermined instruction or state of display (state transition data). The state transition controller 1 controls the state of display in accordance with the state transition data 11-i. The other aspects of the operation of the ninth embodiment are the same as the corresponding aspects of FIG. 1 (FIG. 1) and the description thereof is omitted.

Thus, according to the ninth embodiment, the plurality of types of state transition data 11-1–11-4 are stored in the state transition data storage unit 2 so that the state transition data used by the state transition controller 1 is selected in accordance with the predetermined instruction or the state of display. When a minor change is required in the state transition data during the course of development of the apparatus, the entirety of the state transition data need not be changed of the plurality of types of transition data, only the state transition data corresponding to the required changed need be changed. Therefore, the efficiency of development is improved. Development of the apparatus relative to the state transition data 11-i can proceed in a manner independent of the other state transition data 11-i.

When the state transition data is read from the recording medium as disclosed in the fifth embodiment, the ninth embodiment also provides an advantage in that state transition data is modified rapidly, since the volume of data that is read to effect a minor change in the sate transition data is relatively small.

It is assumed in the ninth embodiment that there are four types of state transition data stored in the state transition data storage unit 2. However, a desired number of types of drawing data may be stored. The ninth embodiment may be implemented in combination with the seventh and eighth embodiments. The drawing data storage unit 3 according to the ninth embodiment may store a plurality of types of drawing data (and the auxiliary drawing data) and the drawing controller 4 may include the drawing data switching unit 91 (and the auxiliary drawing data retaining part 92).

The first through ninth embodiments are applied to the menu display of the on-vehicle navigation apparatus. However, they may find applications in apparatuses other than the on-vehicle navigation apparatus and in graphics other than a menu.

The present invention is not limited to the above-described embodiments, and variations and modifications may be made without departing from the scope of the present invention.

What is claimed is:

1. An image display apparatus for changing a state of a display in accordance with state transition data corresponding to an instruction, producing post-transition display data from drawing data, and displaying an image based on the post-transition display data, comprising:

a drawing data storage unit for storing drawing data including at least one graphic element and at least one animation element, the graphic element including a basic element of the image and attributes of the basic element, and the animation element being associated with the graphic element and describing a condition and a procedure for dynamically changing attributes of the graphic element when the condition is fulfilled; and a drawing controller for executing the procedure to change the attributes of the graphic element, when the condition is fulfilled, and producing the post-transition display data based on the graphic element.

2. The image display apparatus according to claim 1, wherein said drawing controller draws the image after producing display data of the image as a whole from the graphic element.

3. The image display apparatus according to claim 1, further comprising a drawing data reading unit for reading drawing data recorded in a recording medium.

4. The image display apparatus according to claim 1, further comprising a state transition data reading unit for reading state transition data recorded in a recording medium.

5. The image display apparatus according to claim 1, further comprising a state transition data storage unit modifiably storing the state transition data.

6. The image display apparatus according to claim 1, further comprising a data communication unit for communicating with an external apparatus to retrieve the state transition data.

7. The image display apparatus according to claim 1, wherein said drawing data storage unit stores a plurality of drawing data, and said drawing controller comprises a drawing data switching unit for selecting by switching, drawing data used in producing the display data, in accordance with the state transition data.

8. The image display apparatus according to claim 7, wherein said drawing data storage unit stores, for each drawing data, auxiliary drawing data comprising one of color information and image element of the drawing data, and said drawing controller produces the display data using the auxiliary drawing data corresponding to the drawing data selected by said drawing data switching unit.

9. The image display apparatus according to claim 1, further comprising:

a state transition storage unit for storing a plurality of state transition data;

a state transition controller for changing the state of display, based on one of the plurality of state transition data;

state transition data switching unit for selecting by switching the state transition data used by said state transition controller, in accordance with the instruction or the state of display.

10. The image display apparatus according to claim 1, wherein the graphic element is at least one of lines, figures, characters, and images.

11. The image display apparatus according to claim 1, wherein the graphic element is stored in said drawing data storage unit in as a list.

12. The image display apparatus according to claim 1, wherein a plurality of animation elements are attached to the graphic element.

13. The image display apparatus according to claim 1, wherein the attributes are position of display, size, and drawing color.

14. The image display apparatus according to claim 1, wherein a determination is made as to whether the procedure is executed based on the animation variable.

15. The image display apparatus according to claim 1, wherein one of the drawing data and the state transition data is variable.

16. An image display method for changing a state of display in accordance with state transition data corresponding to an instruction, producing post-transition display data from drawing data, and displaying an image based on the post-transition display data, comprising:

determining whether a condition for a change in the state of display is fulfilled, given drawing data including at least one graphic element and at least one animation element, the graphic element including a basic element of the image and attributes of the basic element, and the animation element being associated with the graphic element and describing a condition and a procedure for dynamically changing attributes of the graphic element when the condition is fulfilled, by determining whether the condition is fulfilled; and executing the procedure to change the attributes of the graphic element, when the condition is fulfilled; and producing the post-transition display data based in the graphic element.

* * * * *

UNITED STATES PATENT AND TRADEMARK OFFICE

CERTIFICATE OF CORRECTION

PATENT NO. : 6,639,601 B1
DATED : July 1, 2003
INVENTOR(S) : Asai et al.

It is certified that error appears in the above-identified patent and that said Letters Patent is hereby corrected as shown below:

Title page,
Item [56], References Cited, add:
-- U.S. PATENT DOCUMENTS,

| | | |
|---|---|---|
| 4,862,392 | 8/1989 Steiner | 364/522 |
| 5,119,477 | 6/1992 Ebbers | 395/160 |
| 5,642,475 | 6/1997 Itoh et al. | 395/133 |
| 5,862,395 | 1/1999 Bier | 395/800.01 --. |

Signed and Sealed this

Seventeenth Day of January, 2006

JON W. DUDAS
*Director of the United States Patent and Trademark Office*

UNITED STATES PATENT AND TRADEMARK OFFICE

CERTIFICATE OF CORRECTION

PATENT NO. : 6,639,601 B1
DATED : October 28, 2003
INVENTOR(S) : Asai et al.

It is certified that error appears in the above-identified patent and that said Letters Patent is hereby corrected as shown below:

Title page,
Item [56], References Cited, add:
-- U.S. PATENT DOCUMENTS,

| | | |
|---|---|---|
| 4,862,392 | 8/1989 Steiner | 364/522 |
| 5,119,477 | 6/1992 Ebbers | 395/160 |
| 5,642,475 | 6/1997 Itoh et al. | 395/133 |
| 5,862,395 | 1/1999 Bier | 395/800.01 --. |

This certificate supersedes Certificate of Correction issued January 17, 2006.

Signed and Sealed this

Twenty-first Day of March, 2006

JON W. DUDAS
*Director of the United States Patent and Trademark Office*